US005078563A

United States Patent [19]

Lolli

[11] Patent Number: 5,078,563

[45] Date of Patent: Jan. 7, 1992

[54] UNIVERSAL BINDING ELEMENT FOR BINDING LOOSE DOCUMENTS IN A FILE

[76] Inventor: Carla P. Lolli, Jan Van Rijswijcklaan 76, 2018 Antwerpen, Belgium

[21] Appl. No.: 474,800

[22] PCT Filed: Oct. 4, 1989

[86] PCT No.: PCT/BE89/00046

§ 371 Date: Jun. 7, 1990

§ 102(e) Date: Jun. 7, 1990

[87] PCT Pub. No.: WO90/03889

PCT Pub. Date: Apr. 19, 1990

[30] Foreign Application Priority Data

Oct. 7, 1988 [BE] Belgium ..... 8801155

[51] Int. Cl.[5] ..... B42C 9/00; B42D 1/00; B42D 5/00

[52] U.S. Cl. ..... 412/8; 251/15.1; 251/21.1; 251/29; 412/900; 412/901

[58] Field of Search ..... 156/200, 201, 202, 216, 156/908; 281/15.1, 21.1, 23, 34, 35, 36, 37, 29; 412/8, 900, 901

[56] References Cited

U.S. PATENT DOCUMENTS

| | | | |
|---|---|---|---|
| 3,833,244 | 9/1974 | Heimann | 281/21.1 |
| 4,441,950 | 4/1984 | Lolli | 156/216 |

FOREIGN PATENT DOCUMENTS

| | | | |
|---|---|---|---|
| 304445 | 1/1973 | Austria . | |
| 869886 | 2/1979 | Belgium . | |
| 8701029 | 5/1989 | Belgium . | |
| 1001922A3 | 3/1990 | Belgium . | |
| 0140197 | 12/1986 | European Pat. Off. . | |
| 2904456 | 2/1980 | Fed. Rep. of Germany . | |
| 8804396.7 | 7/1988 | Fed. Rep. of Germany . | |
| 363325 | 9/1962 | Switzerland . | |
| 365702 | 1/1963 | Switzerland . | |
| 1239721 | 7/1971 | United Kingdom . | |
| 2184981 | 7/1987 | United Kingdom | 281/29 |

*Primary Examiner*—Paul A. Bell
*Attorney, Agent, or Firm*—Foley & Lardner

[57] ABSTRACT

Universal binding element for binding loose documents in a file, characterized in that it principally consists of an inner cover formed of a first part (2) that is intended for forming a front sheet; a second part (3) that is intended for forming a back sheet; and a third part (4) that is intended for forming a spine, which includes adhesive means (5) which are formed of glue (9, 10, 23) meltable under the influence of heat and which, when heated and subsequently cooled can provide for an adhesive connection on both the inside (6) and the outside (7) of the formed spine.

21 Claims, 2 Drawing Sheets

UNIVERSAL BINDING ELEMENT FOR BINDING LOOSE DOCUMENTS IN A FILE

BACKGROUND OF THE INVENTION

1, Field of the Invention

This invention relates to a universal binding element for binding loose documents in a file.

More particularly the present invention relates to a binding element of the type that allows a bundle of loose documents to be brought together in a unit that is formed by the binding element and the bundle of bound documents being attached in a suitable existing file of any material, whereby use is made of a layer of glue which is meltable under the influence of heat for the purpose of at least joining the loose documents.

2. Related Art

Files which are provided with a supple spine on which a layer of glue meltable under the influence of heat is applied on the inside are already known, for example as described in the Belgian patent no. 869.886 (U.S. Pat. No. 4,441,590). These files are intended as outer covers, through which their utilisation remains exclusively limited to the use of always the same binder.

In order to be able to apply thermal binding systems more universally, binding elements of the already mentioned type were then also developed. They allow a bundle of documents to be bound and at the same time provide a simple attachment of such binding element in any type of binder of file, whether of paper, cardboard, plastic, leather or similar material.

Binding elements of this type are described in Belgian patent application nos. 8701029 and 8800689 (U.S. application Ser. No. 07/477,802).

According to Belgian patent application no. 8701029 use is made of a binding element that principally consists of a spine on which a layer of glue meltable under the influence of heat is applied on the inside and a flap provided along at least one side of the spine which comes sideways along the bundle of documents when binding and which is provided with a double sided strip of adhesive tape on its outside. The loose documents are bound in a thermal manner, while the attachment of the formed bundle to the outer cover is effected by means of the double adhesive tape, which provides for the attachment between the back of the bound bundle of documents and the back sheet of the outer cover.

Notwithstanding the fact that this binding system is very economical in certain applications, its utilisation is rather difficult because two attaching systems are applied, on the one hand, the melting glue and, on the other hand, the double sided adhesive tape. Furthermore, the binding element according to the Belgian patent no. 8701029 is only applicable where the bundle of documents may be attached to the back sheet of the outer cover and whereby the direct attachment of the bundle to the spine of the outer cover is not desired.

From Belgian patent application no. 8800689 a binding element is known that consists of a sheet of relatively stiff material and a strip of glue applied over the length of one edge of this sheet which extends past the sheet. The bundle of documents to be bound, the binding element and an outer cover are brought together in the thermal binding device, after which simultaneously, through the melting of the glue, on the one hand, the loose documents are bound together and, on the other hand, these documents are attached directly to the spine of the outer cover.

Notwithstanding the good results which can also be achieved with the binding element according to the BE 8800689, such binding element presents difficulty when installing the unit in the heating apparatus. The somewhat protruding strip of glue is sometimes difficult to position, whereby this strip can become folded double under the bundle of loose documents, whereby the documents are only partly bound.

Likewise according to the Belgian patent application no. 8800689 the strip of glue overlaps against the outside of the aforementioned sheet, i.e., the side which is directed away from the bundle of documents. With the installation of the outer cover and the melting together of the unit the attachment arises not only between the spine of the bundle of documents and the spine of the outer cover, but also partly between the front sheet of the bundle and the front sheet of the outer cover, which can be undesirable for certain applications. When this binding element is applied by inexperienced people who do not sufficiently press the front and back sheets of the bundle, these front and back sheets may not come into contact with the glue.

SUMMARY OF THE INVENTION

The present invention relates to a universal binding element that does not have the aforementioned and other inconveniences with one thermal treatment the loose documents are mutually attached and the bundle of documents are simultaneously attached to the spine of the outer cover, particularly good binding can be achieved for the front and back sheets of the loose documents as well as an attachment to the spine of an outer cover.

For this purpose the invention concerns a universal binding element, for binding loose documents in a file. It principally consists in an inner cover being formed of a first part that is intended for forming a front sheet; a second part that is intended for forming a back sheet; and a third part that is intended for forming a spine, which includes adhesive means which are mainly formed of glue meltable under the influence of heat and which, when heated and subsequently cooled, provide an adhesive connection on both the inside and the outside of the formed spine.

BRIEF DESCRIPTION OF THE DRAWINGS

In order to better appreciate the characteristics according to the present invention, several preferred embodiments are described hereafter, as examples and without any restrictive character, with reference to the enclosed drawings, in which.

DETAILED DESCRIPTION OF THE PREFERRED EMBODIMENT

Figure 1:
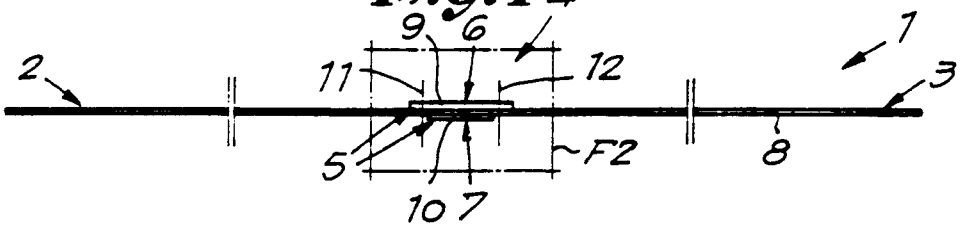
FIG. 1 is a schematic side elevational view of a first embodiment of the invention.

As shown in the figures the binding element according to the invention principally consists of an inner cover 1 formed of a first part 2 that is intended for forming a front sheet; a second part 3 that is intended for forming a back sheet; and a third part 4 that is intended for forming a spine. Part 4 includes an adhesive means 5 which can provide for a gluing attachment both on the inside 6 of the formed spine and on the outside 7 of the formed spine.

In a first preferred embodiment the aforementioned first, second and third parts, respectively 2–4, principally consist of one continuous sheet 8, of paper, lightweight cardboard or any other material, for example plastic. The adhesive means 5 consist of a first and second amount of glue, respectively 9 and 10, applied on both sides of sheet 8 at the place which is intended to form the spine.

In order to obtain, on the one hand, a bundle of documents that are effectively glued in place in the binding element 1, and, on the other hand, the attachment between the only binding element 1 and an outer cover, the amount of glue 9 applied on the inside 6 is preferably larger than the amount of glue 10 applied on the outside 7. The amounts of glue 9 and 10 are preferably in the form of strips, which extend over the length or almost the complete length of the spine to be formed. As is again shown in FIG. 1 the strip of glue 9 is preferably wider than the strip of glue 10, all of which such that the glue 9 extends to outside the locations 11 and 12, where the folding edges of the spine will be formed, while the amount of glue 10 is situated inside these locations 11 and 12.

Figure 2:
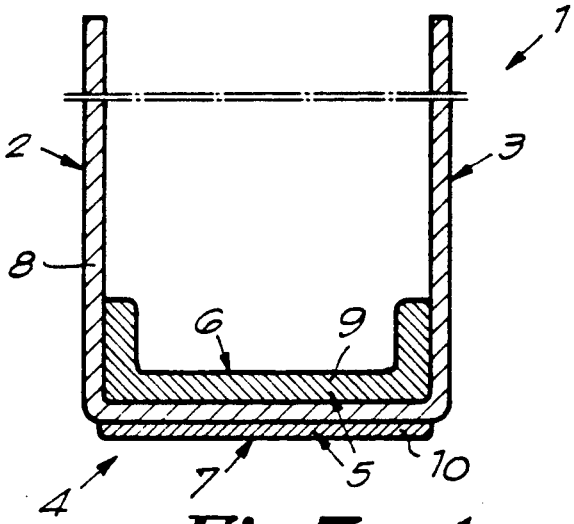
FIG. 2 is a larger scale cross-sectional view of a preformed embodiment of the part indicated by F2 in FIG. 1.

The user friendliness of the product of FIG. 1 can be further improved by producing it as a preformed cover, as shown in FIG. 2.

Figure 3:
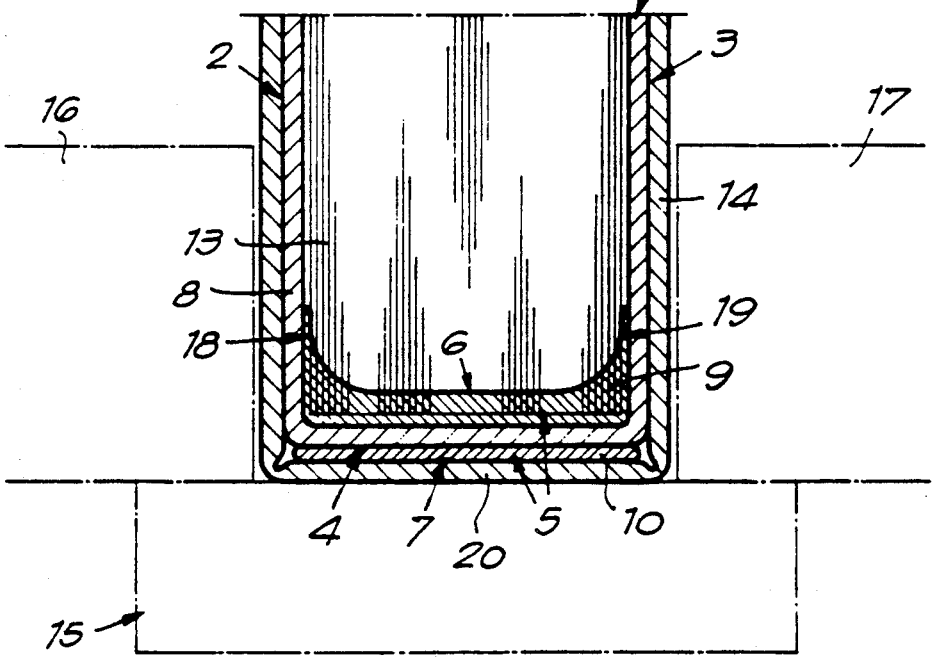
FIG. 3 is a cross-sectional view of a bundle of documents bound by means of the binding element of FIG. 2.

FIG. 3 shows the use of the binding element 1 according to FIGS. 1 and 2. The binding element has the bundle of loose documents 13 inserted therein. An outer cover 14 of any material is placed with the spine of the unit against a heating plate 15 and between a pair of supports 16 and 17 of a thermal binding apparatus. Through the applied heat the amounts of glue 9 and 10 melt, whereby the glue 9 penetrates between the documents 13 and after cooling and solidifying provides a solid connection between the bundle of documents 13 and the binding element 1, while the glue 10 melts simultaneously which after cooling and solidifying provides for the attachment between the binding element 1 and the outer cover of the file 14.

From FIG. 3 the importance of the width of the strip of glue 9 also appears. Because the glue 9 initially extends past the folding edges of the spine of the binding element 1, very good attachment also develops at the locations 18 and 19. In other words, a good bond develops between the binding element 1 and the frontmost, and rearmost documents of the bundle of documents 13, whereby even with some shifting of these sheets the contact with the glue during the melting is ensured. By keeping the amount of glue 10 limited the glue does not spread out too much, and a very good local attachment is obtained between the binding element 1 and the spine 20 of the outer cover of the file 14, whereby in so doing it is avoided that excess glue reaches the side sheets of the binding element I and the outer cover 14. This does not however exclude that in certain applications the strip of glue 10 may be selected wider than the spine of the unit.

Figure 4:
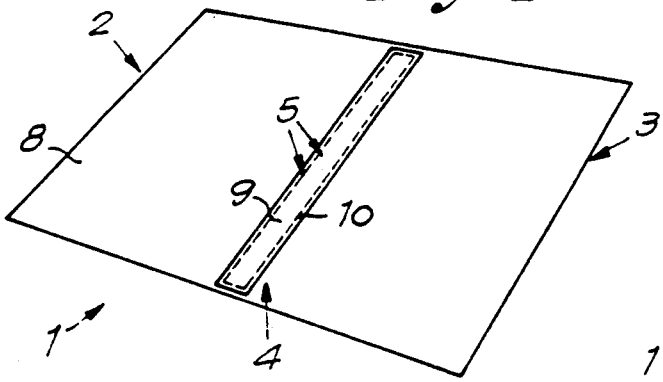
FIG. 4 illustrates the binding element from FIG. 1 in perspective.
Figure 5:
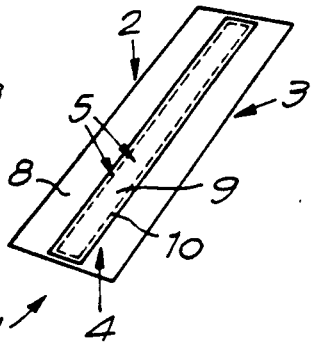
FIG. 5 shows a variant of the binding element according to FIG. 4.

The front sheet and the back sheet of the binding element 1, in other words the aforementioned parts 2 and 3, do not need to cover the complete surface of the bundle of documents 13 to be bound. FIG. 4 illustrates an embodiment whereby this is the case, while FIG. 5 shows an embodiment whereby the intended front and back sheet of the binding element only show the form of a strip. It is clear that according to another variant one of the two parts 2 or 3 provide for a sheet that corresponds to the complete surface of the documents to be bound, while the other part provides for a sheet that only consists of a strip. The fact that at least one of the two parts 2 and 3 consists of a sheet that covers the complete surface of the bundle of documents 13 to be bound offers the advantage that the adhesive means 5 can more easily be positioned during the binding, thus when the unit is placed in the thermal binding apparatus. In order to facilitate this positioning still further, a complete sheet is preferably applied which, as described in the Belgian patent application no. 8800690 of Applicant, consists of a relatively stiff material not meltable under the influence of heat.

Figure 6:
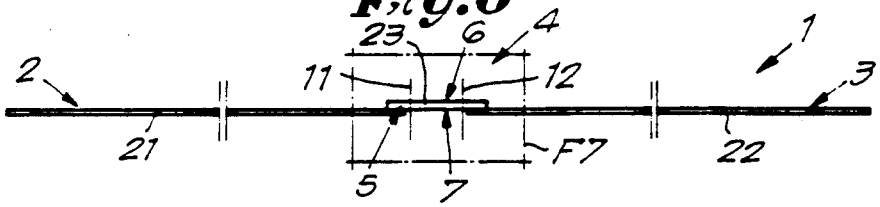
FIG. 6 is a schematic side elevational view of a second embodiment of the invention.

In a second embodiment, according to FIG. 6, the first part 2 and the second part 3 each consist of a separate sheet 21 and 22, whereby these sheets may or may not correspond with the complete surface of the documents to be bound, while the third part 4 solely consists of the aforementioned adhesive means 5 which in the form of a solidified layer of glue 23 form an attachment between the two sheets 21 and 22. The layer of glue 23 is preferably melted into place overlapping on the sheets 21 and 22 along the side 6 which is intended to form the inside of the binding element I. The sheets 21 and 22 preferably consist of paper or a lightweight cardboard. It is however clear that other materials such as plastic can also be applied.

Figure 7:
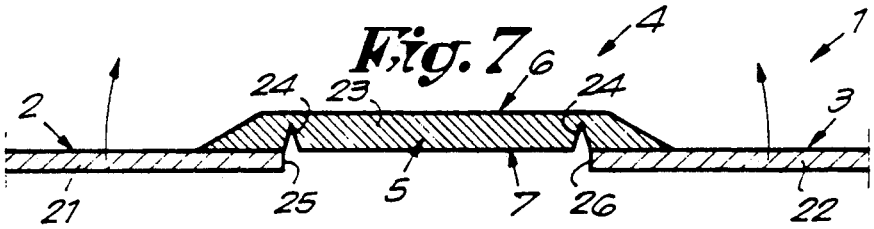
FIG. 7 is a larger scale cross-sectional view of the part indicated by F7 in FIG. 6.

As shown in FIG. 7 the layer of glue 23 can be provided with at least two indentations 24 extending in the longitudinal direction of the spine, through which the formation of precise, rectilinear folds is facilitated at ambient temperature. The indentations 24 are preferably situated just next to the edges 25 and 26 of the sheets 21 and 22.

Figure 8:
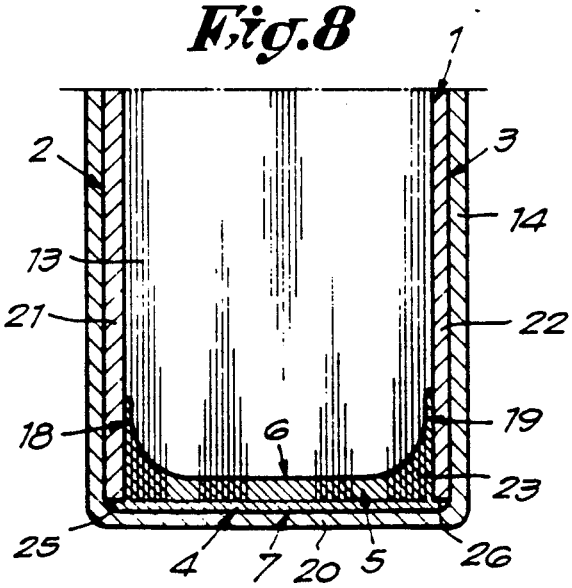
FIG. 8 shows the application of the binding element according to FIG. 7.

FIG. 8 shows a bundle of documents 13 which is attached in an outer cover 14 by means of the binding element 1 according to FIGS. 6 and 7. It is clear that the glue 23 hereby provides for the direct attachment between the documents 13 and the spine 20 of the outer cover 14.

It is clear that the present invention also relates to the bound bundles of documents which are obtained by means of a binding element 1 according to the present invention.

The present invention is in no way restricted to the embodiments described as examples and shown in the drawings, but such binding element for binding loose documents in a file may be developed in different forms and dimensions without departing from the scope of the present invention.

I claim:

1. A method of binding loose documents, comprising:

(a) forming a front cover sheet and a back cover sheet;

(b) forming a spine by positioning a meltable glue adhesive on both an inside and an outside of the formed spine and on the front and back cover sheets;

(c) folding the cover sheets substantially parallel to each other;

(d) inserting loose documents between the cover sheets and against the glue adhesive on the spine;

(e) placing an outer cover over the outside of the spine and the cover sheets;

((g) heating the glue adhesive;

(g) cooling the glue adhesive to retain the documents between the cover sheets and binding the outer cover to the spine.

2. The method of claim 1 including forming the front and back cover sheets of a single continuous sheet.

3. The method of claim 2 including applying the glue adhesive to an inside and an outside of the continuous sheet at the spine.

4. The method of claim 3 including placing a greater amount of glue adhesive on the inside than on the outside.

5. The method of claim 3 including applying the glue adhesive in the form of strips.

6. The method of claim 3 including extending the inside glue adhesive beyond where the cover sheets are folded.

7. The method of claim 1 including forming the front and back cover sheets of two separate sheet and applying the glue adhesive between and overlapping the separate sheets.

8. The method of claim 7 including forming longitudinal indentations in the glue adhesive prior to heating.

9. Universal binding element for binding loose documents in a file comprising:

an inner cover formed of a first part (2) intended for forming a front sheet;

a second part (3) intended for forming a back sheet;

the first part (2) and the second part (3) comprise separate sheets (21,22)

a third part (4) intended for forming a spine which comprises only a layer of glue;

adhesive means (5) formed by the layer of glue (23) which is meltable under the influence of heat and which, when heated and subsequently cooled connects the sheets (21,22) and provides an adhesive connection on both an inside (6) and an outside (7) of the formed spine.

10. Universal binding element according to claim 9 wherein the layer of glue (23) is applied overlapping the separate sheets.

11. Universal binding element according to claim 10, wherein the layer of glue (23) overlaps on the inside (6) of the binding element intended to lie against the bundle of documents (13).

12. Universal binding element according to claim 9 wherein the layer of glue (23) is provided with indentations (24) extending outward in a longitudinal direction of the spine.

13. Universal binding element for binding loose documents in a file, comprising:

an inner cover formed of a first part (2) intended for forming a front sheet;

a second part (3) intended for forming a back sheet; and a third part (4) intended for forming a spine;

adhesive means (5) formed of glue (9, 10, 23) meltable under the influence of heat and which, when heated and subsequently cooled provides an adhesive connection on both an inside (6) and an outside (7) of the formed spine.

14. Universal binding element according to claim 13, wherein the first part (2), the second part (3) and the third part (4) principally are formed of one continuous sheet (8), while the adhesive means (5) includes amounts of glue (9, 10) applied on both sides of the sheet (8) at the spine.

15. Universal binding element according to claim 14, wherein a greater amount of glue (9) is applied on the inside (6) of the binding element (1) than on the outside (7).

16. Universal binding element according to claim 14 wherein the amounts of glue (9, 10) are applied on the sheet (8) in the form of strips.

17. Universal binding element according to claim 14 wherein the amount of glue (9) on the inside (6) which is intended to be attached to the bundle of documents (13) to be bound, extends over a width which reaches further than locations (11, 12) which are intended to form a pair of folding edges of the spine during binding, while the second amount of glue (10) which is on the outside (7), is situated completely inside the folding edges to be formed.

18. Universal binding element according to claim 14 wherein the binding element it is preformed.

19. Universal binding element according to claim 13, wherein the first part (2) and the second part (3) are essentially of paper.

20. Universal binding element according to claim 13 wherein both the first part (2) and the second part (3) comprise a front sheet and a back sheet, the size of which corresponds to the size of the bundle of documents (13) to be bound.

21. Universal binding element according to claim 13 wherein t least one of the two parts (2, 3) comprises a strip.

* * * * *